United States Patent [19]

Rowley

[11] 4,429,296

[45] Jan. 31, 1984

[54] THERMOSTAT CONSTRUCTION HAVING A ONE-PIECE V-SHAPED LEAD AND METHOD OF MAKING THE SAME

[75] Inventor: Paul M. Rowley, Bexley, Ohio

[73] Assignee: Robertshaw Controls Company, Richmond, Va.

[21] Appl. No.: 388,128

[22] Filed: Jun. 14, 1982

Related U.S. Application Data

[62] Division of Ser. No. 250,576, Apr. 3, 1981, Pat. No. 4,365,228.

[51] Int. Cl.[3] ..... H01H 37/02

[52] U.S. Cl. ..... 337/338; 337/354

[58] Field of Search ..... 337/299, 300, 337, 338, 337/339, 347, 354, 360

[56] References Cited

U.S. PATENT DOCUMENTS

| | | | |
|---|---|---|---|
| 3,573,700 | 4/1971 | Schmitt | 337/368 |
| 3,870,229 | 3/1975 | Manecke | 337/342 |
| 3,885,222 | 5/1975 | Manecke | 337/338 |

*Primary Examiner*—William H. Beha, Jr.

*Attorney, Agent, or Firm*—Candor, Candor & Tassone

[57] ABSTRACT

A thermostat construction is provided and has a one-piece lead provided with an intermediate portion that has a substantially U-shaped cross-sectional configuration defined by a cross member and a pair of substantially parallel spaced apart legs extending outwardly from the cross member, one of the legs having a movable switch blade integral therewith for one switch of the thermostat construction and the other of the legs carrying a fixed contact for another switch of the thermostat construction whereby the switch blade and the fixed contact are disposed in offset planes by the legs of the one-piece lead.

10 Claims, 10 Drawing Figures

THERMOSTAT CONSTRUCTION HAVING A ONE-PIECE V-SHAPED LEAD AND METHOD OF MAKING THE SAME

CROSS REFERENCE TO RELATED APPLICATION

This application is a divisional patent application of its copending parent patent application, Ser. No. 250,576 filed Apr. 3, 1981, now U.S. Pat. No. 4,365,228.

BACKGROUND OF THE INVENTION

1. Field of the Invention

This invention relates to an improved thermostat construction and to a method of making the same.

2. Prior Art Statement

It is known to provide a thermostat construction having a frame means carrying a fixed contact and a movable contact carried by a switch blade together with a bimetallic snap disc for controlling movement of the switch blade relative to the fixed contact in response to temperature sensing conditions of the bimetal snap disc. Temperature setting means are carried by the frame means for selecting the temperature of operation of the snap disc for moving the movable contact out of contact with the fixed contact. The temperature setting means comprises a plunger means passing loosely through an opening means in the switch blade and engaging the snap disc. The temperature setting means includes spring means operatively associated with the plunger means to urge the plunger means into engagement with the snap disc and has adjusting means for adjusting the force of the spring means that urges the plunger means into its engagement with the snap disc.

For example, see the following two U.S. patents:

(1) U.S. Pat. No. 3,870,229—Manecke (2) U.S. Pat. No. 3,885,222—Manecke

It appears that the plunger means of the thermostat constructions of each item (1) and (2) above is formed of two parts telescoped together with the switch blade being disposed intermediate portions of those two parts, the plunger means requiring a separate guide part for guiding movement thereof in the housing means.

Another known thermostat construction does not have the plunger means passing through the switch blade which is operated thereby.

For example, see the following U.S. patent:

(3) U.S. Pat. No. 3,573,700—Schmidt

It is also known to provide a one-piece plunger means disposed between a bimetallic snap disc and switch blade means to move the switch blade means when the snap disc snaps over center, the one-piece plunger means having an intermediate part that passes between a pair of switch blade means and is to be engaged by a resetting means of the thermostat construction.

For example, see the following two U.S. patents:

(4) U.S. Pat. No. 3,675,178—Place (5) U.S. Pat. No. 3,885,222—Menecke

The one-piece plunger member of the thermostat construction of item (4) above has a wing-like section which at one end thereof has end parts for respectively engaging against the two switch blade members and those end parts have a contoured cross section of which the apex thereof is to engage against the switch blade members. The wing-like section has extensions extending beyond the opposed ends thereof, one of the extensions for engaging against the snap disc and the other extension for engaging against the reset member when the reset member is actuated.

It is also known to provide a thermostat construction having a housing carrying a pair of thermostatically operated electrical switch means disposed therein in spaced apart and side-by-side relation and being electrically interconnected in series by a one-piece lead means carried internally in the housing and having opposed ends while being secured to the housing intermediate the opposed ends thereof whereby the ends are disposed in cantilever fashion with those ends respectively forming part of the switch means.

For example, see the following U.S. patent:

(6) U.S. Pat. No. 3,885,222—Manecke

The rigid lead means of the thermostat construction of item (6) above has the switch blade of one of the switch means riveted thereto at one end of the rigid lead means and has a fixed contact of the other switch means secured to the other end thereof.

Items (2), (5) and (6) above are the same U.S. Pat. No. 3,885,222.

SUMMARY OF THE INVENTION

It is a feature of this invention to provide improved lead means for electrically interconnecting in series a pair of thermostatically operated electrical switch means that are disposed in the same housing.

In particular, while a rigid lead means has been utilized in the past to electrically interconnect in series a pair of thermostatically operated switch means by having the rigid lead means secured to the housing intermediate the ends thereof so that the ends can be disposed in cantilevered fashion and respectively from part of the pair of switch means, it was found according to the teachings of this invention that the rigid lead means can be formed in a unique manner from switch blade material and thereby not only provide the same function as the rigid lead means previously utilized, but also have a portion thereof formed to be the switch blade of one of the thermostatically operated electrical switch means being electrically interconnected in series thereby.

For example, one embodiment of this invention provides a control device having a housing carrying a pair of thermostatically operated electrical switch means disposed therein in spaced apart side-by-side relation and being electrically interconnected in series by a one-piece lead means carried internally in the housing and having opposed end and an intermediate portion while being secured to the housing intermediate those ends whereby the opposed ends are disposed in cantilever fashion with the ends respectively forming part of the switch means, the intermediate portion of the lead means having a substantially U-shaped cross-sectional configuration defined by a cross member and a pair of substantially parallel spaced apart legs extending outwardly from the cross member. One of the legs has a movable switch blade integral therewith at one of the opposed ends of the lead means and extending outwardly therefrom for its respective switch means. The other of the legs carries a fixed contact means for the other switch means at the other of the opposed ends of the lead means whereby the switch blade and the fixed contact means are disposed in offset planes by the legs of the one piece lead means.

Accordingly, it is an object of this invention to provide an improved thermostat construction or control device having one or more of the novel features of this invention as set forth above or hereinafter shown or described.

Another object of this invention is to provide a method of making such a thermostat construction or control device, the method of this invention having one or more of the novel features of this invention as set forth above or hereinafter shown or described.

Other objects, uses, and advantages of this invention are apparent from a reading of this description which proceeds with reference to the accompanying drawings forming a part thereof and wherein:

DESCRIPTION OF THE PREFERRED EMBODIMENTS

Figure 1:
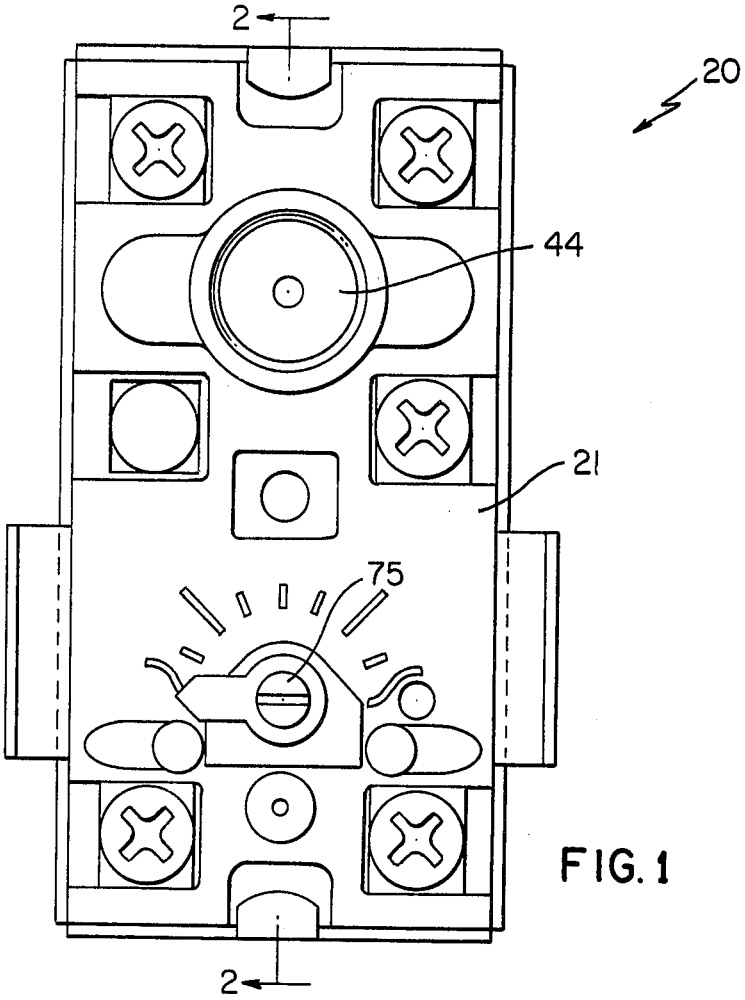
FIG. 1 is a front view of the improved thermostat construction or control device of this invention.

While the various features of this invention are hereinafter described and illustrated as being particularly adapted to provide a thermostat construction or control device for a water heater or the like, it is to be understood that the various features of this invention can be utilized singly or in any combination thereof to provide a thermostat construction or control device for other apparatus as desired.

Therefore, this invention is not to be limited to only the embodiments illustrated in the drawings, because the drawings are merely utilized to illustrate one of the wide variety of uses of this invention.

Referring now to FIGS. 1–6, one embodiment of the improved thermostat construction or control device of this invention is generally indicated by the reference numeral 20 and comprises a housing means 21 defining two spaced apart and side-by-side electrical switch chambers 22 and 23 respectively closed by a rear cover member 24 that contains the outer peripheral edges 25 and 26 of a pair of bimetallic snap discs 27 and 28 against shoulder means 29 and 30 of the housing means 21 whereby the snap discs 27 and 28 are respectively utilized to thermostatically operate electrical switch means that are respectively disposed in the switch chambers 22 and 23 and are respectively generally indicated by the reference numerals 31 and 32.

It is to be understood that the general features and operation of the thermostat construction or control device 20 of this invention is substantially the same as the thermostat constructions and control devices fully set forth in the aforementioned U.S. patents to Manecke whereby such U.S. patents to Manecke, U.S. Pat. Nos. 3,870,223 and 3,885,222, are being incorporated into this disclosure by reference thereto. Therefore, this disclosure need not fully describe all of the parts of the control device or thermostat construction 20 as such references provide such material. However, sufficient details of the thermostat construction 20 will now be described in order to fully understand the claimed feartures of this invention.

Figure 2:
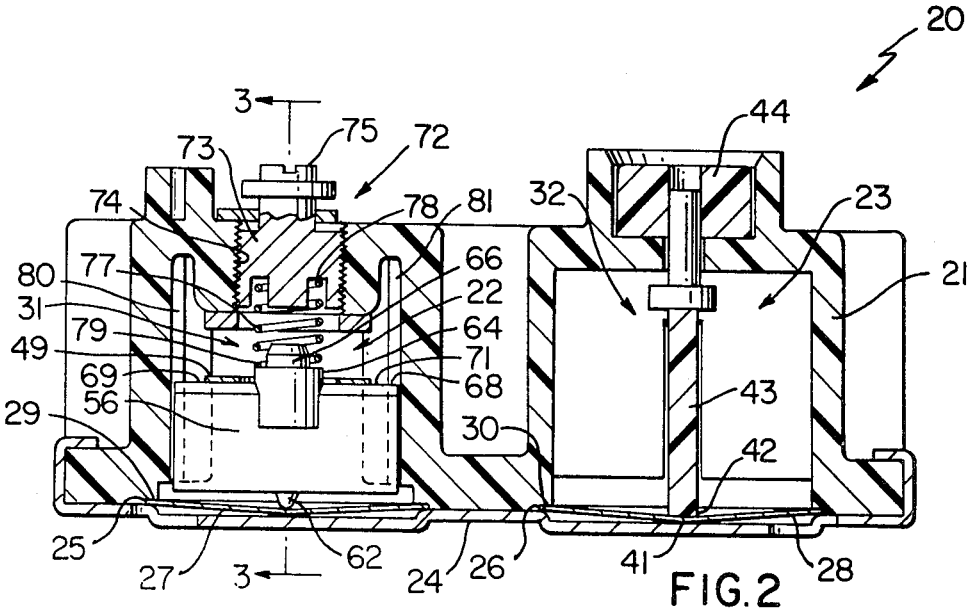
FIG. 2 is a cross-sectional view taken on line 2—2 of FIG. 1.
Figure 6:
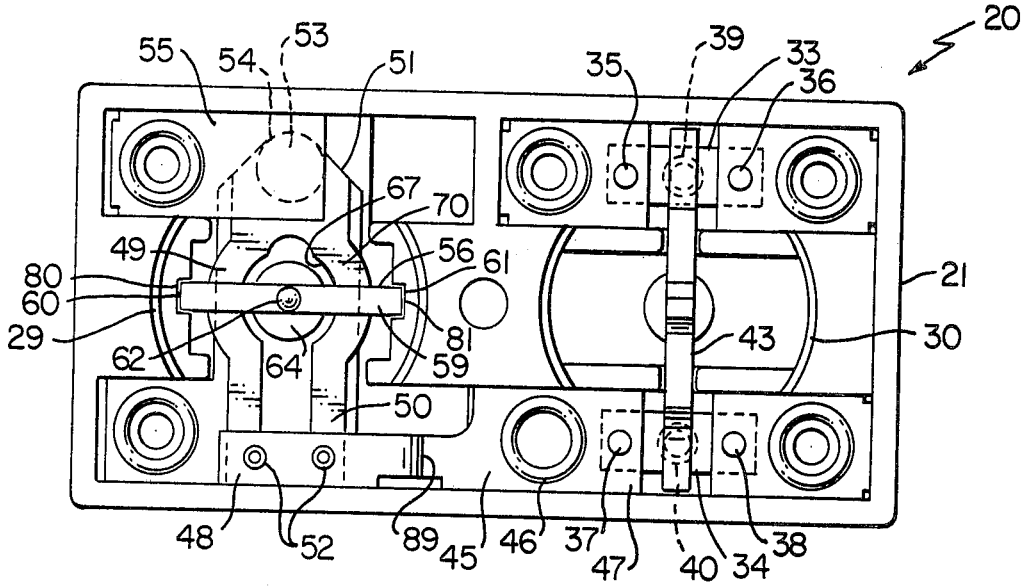
FIG. 6 is a rear view of the thermostat construction of FIG. 1 with the rear cover and bimetallic snap discs removed.
Figure 7:
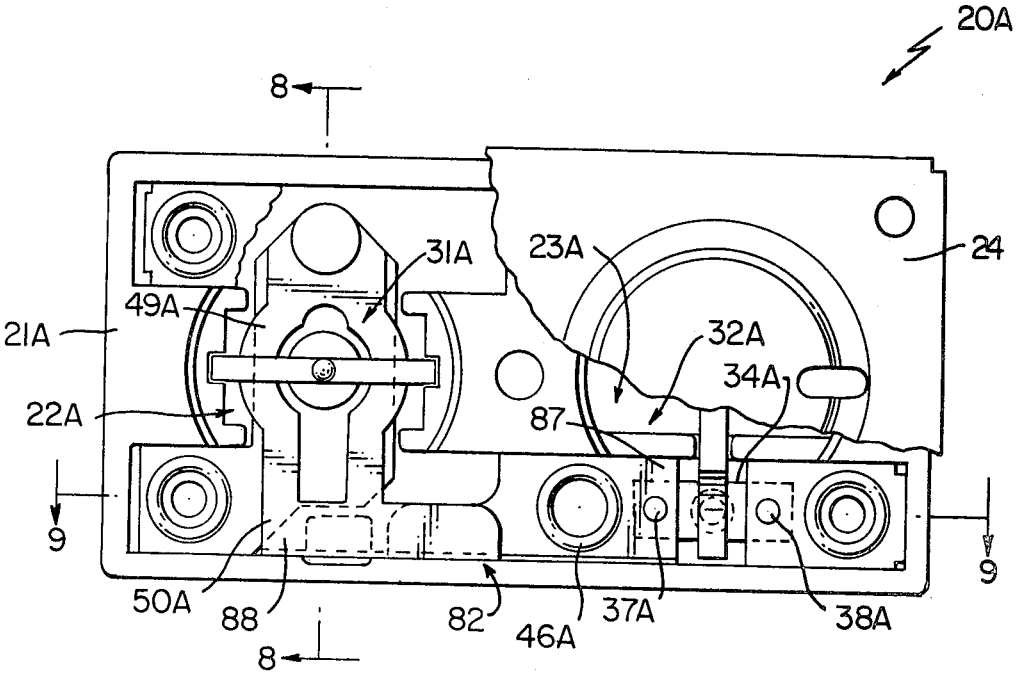
FIG. 7 is a view similar to FIG. 6 and illustrates another embodiment of the thermostat construction or control device of this invention.
Figure 9:
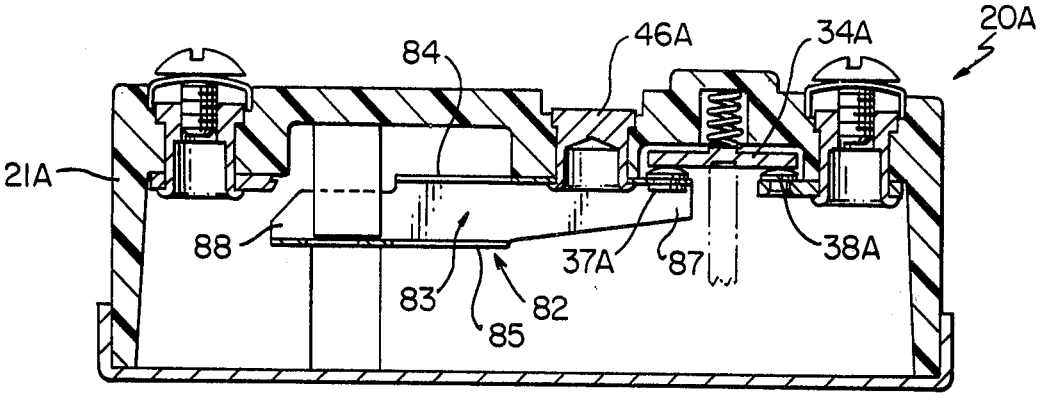
FIG. 9 is a cross-sectional view taken on line 9—9 of FIG. 7.
Figure 8:
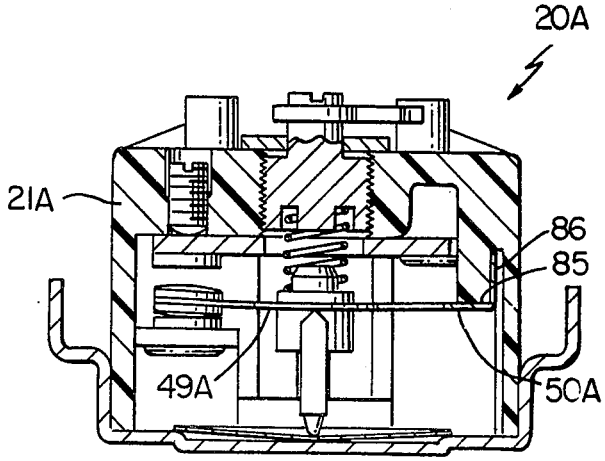
FIG. 8 is a cross-sectional view taken on line 8—8 of FIG. 7.

The electrical switch means 32 comprises a high limit thermostatically operated switch means and includes a pair of movable switch members 33 and 34, FIG. 6, which are respectively adapted to bridge cooperating pairs of fixed contacts 35, 36 and 37, 38 as long as the bimetallic snap disc 28 is in the non-actuated condition of FIG. 2 wherein the same permits spring means 39 and 40 acting on the switch members 33 and 34 to hold the same into contact with the fixed contacts 35, 36 and 37, 38. However, when the bimetallic disc 28 senses a predetermined unsafe high temperature, the disc 28 snaps over center so that the medial portion 41 thereof is now bowed upwardly in FIG. 2 and acts on the end 42 of a one-piece plunger member 43 to move the switch members 33 and 34, in opposition to the force of the compression springs 39 and 40, out of bridging contact with the pairs of fixed contacts 35, 36 and 37, 38 so that all electrical interconnections to the electrical switch means 31 disposed in series with the switch means 32 in the manner hereinafter set forth is discontinued until the switch means 32 is reset to the operating condition of FIG. 2 by a person actuating a reset button 44 for the plunger 43.

As set forth in the aforementioned patents to Manecke, the switch means 32 cannot be reset to an operating condition thereof by pushing in on the reset button 44 until the snap disc 28 is sensing a temperature below an unsafe high temperature thereof.

The high limit thermostatically operated electrical switch means 32 is electrically interconnected in series to the thermostatically operated electrical switch means 31 by a rigid lead member 45, FIG. 6, that is fastened to the housing means 21 by a rivet like fastening member 46 intermediate opposed ends 47 and 48 of the rigid lead member 45 so that the rigid lead member 45 has the opposed ends 47 and 48 thereof disposed in cantilever fashion respectively in the switch chambers 23 and 22, such rigid lead means 45 being fully disclosed and claimed in the afore-mentioned U.S. patent to Manecke, U.S. Pat. No. 3,885,222.

The free end 47 of the rigid lead means 45 carries the fixed contact 37 while the free end 48 of the rigid lead means 45 carries a switch blade 49 of the electrical switch means 31 in cantilever fashion thereto.

Figure 3:
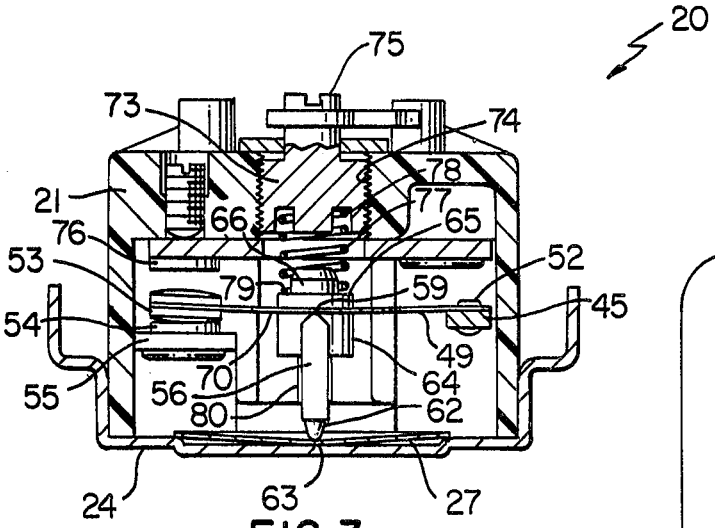
FIG. 3 is a cross-sectional view taken on line 3—3 of FIG. 2.
Figure 5:
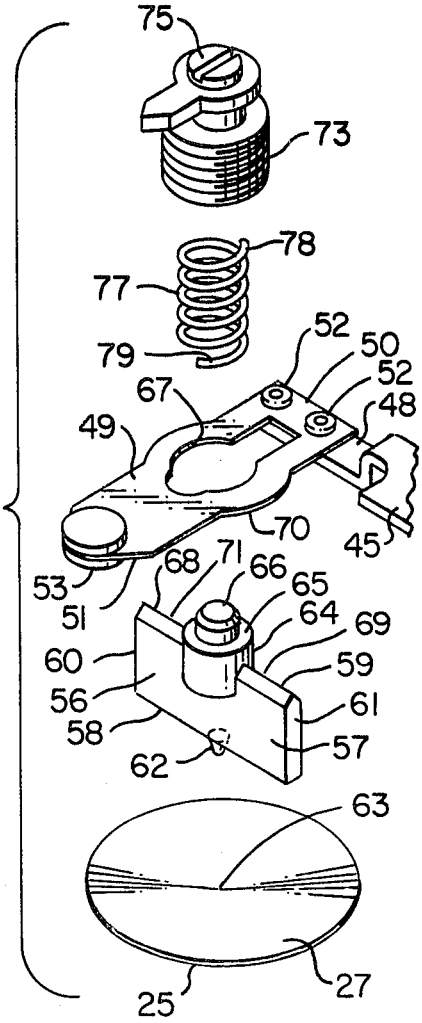
FIG. 5 is an exploded perspective view of certain parts of the thermostat construction of FIG. 1.

In particular, the switch blade 49 has opposed ends 50 and 51, the end 50 being secured to the end 48 of the rigid lead means 45 by rivet like fasteners 52 as best illustrated in FIGS. 3 and 5. The resulting free end 51 of the switch blade 49 carries electrical contact means 53 which is a movable contact means of the switch means 31 and is adapted to cooperate with a fixed contact 54 carried by a terminal means 55 of the housing means 21.

A one-piece plunger member 56 of this invention is utilized for actuating the movable switch blade 49 of the electrical switch means 31, the one-piece plunger member 56 being formed from plastic material or the like by molding or the like and having a wing-like substantially rectangular section 57 that is relatively wide and relatively thin while having a first pair of opposed ends 58 and 59 and another pair of opposed ends 60 and 61 respectively disposed between the first mentioned pair of ends 58 and 59.

A grind away tang or projections 62 extends substantially centrally from the end 58 of the wing-like section 57 to engage against the medial portion 63 of the bimetallic snap disc 27 so as to cause the plunger member 56 to move in unison with the snap disc 27 as will be apparent hereinafter.

The other end 59 of the wing-like section 57 of the plunger member 56 has a cylindrical projection or post 64 extending substantially centrally therefrom and beyond the same, the projection or post 64 defining a substantially flat annular shoulder 65 carrying a reduced cylindrical section 66 substantially centrally thereon. In this manner, the cylindrical post or projection 64 of the plunger means 56 can readily and loosely pass through a substantially circular part of an opening means 67 formed in the switch blade 49 so that the pair of outer parts 68 and 69 of the end 59 of the wing-like section 57 can be engageable against the side 70 of the switch blade 49 on opposite sides of the opening 67 for a purpose hereinafter described, the opposed parts 68 and 69 of the end 59 of the wing-like section 57 having a substantially V-shaped cross section so that the apex 71 thereof will engage against the side 70 of the switch blade 49 in substantially line contact therewith so that the switch blade 49 can be substantially flat and not have "v" sections formed therein as in the switch blade of the aforementioned U.S. patents to Manecke.

Figure 4:
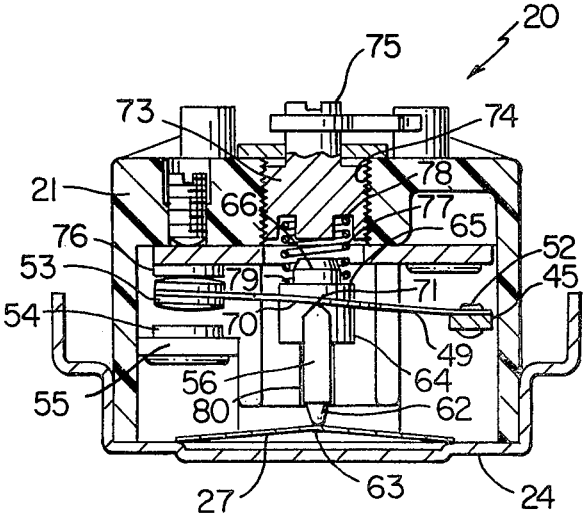
FIG. 4 is a view similar to FIG. 3 and illustrates the thermostat construction in a different operating condition thereof.

The electrical switch means 31 includes a temperature setting means that is generally indicated by the reference numeral 72 and comprises a threaded adjusting member 73 threadedly disposed in a threaded bore 74 formed in the housing means 21 whereby a control knob portion 75 of the adjusting member 73 can be turned to set the operating temperature that the snap disc 27 is to snap over center and move the movable contact 53 away from the fixed contact 54 as illustrated in FIG. 4 and be placed against a stop 76 or other electrical contact of the housing means 21, as the case may be.

The temperature setting means 72 includes a compression spring 77 having one end 78 bearing against the threaded adjusting member 73 and the other end 79 thereof bearing against the annular shoulder 65 of the plunger member 56, the compression spring 77 being a coiled compression spring and thereby having the reduced cylindrical part 66 of the plunger member 56 telescopically received in the end 79 thereof so as to positively locate and retain the end 79 of the compression spring 77 on the surface 65 of the plunger member 56.

Thus, it can be seen that the force of the compression spring 77 can be adjusted by the adjusting member 73 so that the compression spring 77 continuously urges the projection 62 of the plunger member 56 into contact with the central portion 63 of the snap disc 27 so that when the snap disc 27 is in the non temperature actuated condition of FIGS. 2 and 3, the wing-like section 57 of the plunger member 56 permits the natural resiliency of the switch blade 49 to hold its contact 53 into electrical contact with the fixed contact 54 and thereby maintain the electrical switch means 31 in its closed condition.

However, when the bimetallic snap disc 27 senses a temperature as selected by the temperature setting means 72, the disc 27 snaps over center in the manner illustrated in FIG. 4 to cause the end 59 of the wing-like section 57 of the plunger member 56 to move the switch blade 49 upwardly about its pivot point 52 and thereby move the movable contact 53 out of contact with the contact 54 so that the switch means 31 is disposed in the open condition illustrated in FIG. 4 until the snap disc 27 snaps back over center to the condition illustrated in FIGS. 2 and 3 by sensing a temperature below the selected temperature of the temperature setting means 72.

Therefore, it can be seen that the one-piece plunger member 56 of this invention is adapted to control the switch blade 49 of the electrical switch means 31 under the influence of the bimetallic snap disc 27.

In order to guide the movement of the plunger member 56 relative to the housing means 21, the housing means 21 has a pair of narrow guide slots 80 and 81 formed therein and respectively receiving the opposed ends 60 and 61 of the wing-like section 57 of the plunger member 56 therein as illustrated in FIG. 2 to permit the up and down movement of the plunger member 56 relative to the housing means 21, the guide slots 80 and 81 being molded during the molding of the entire housing 21 or being formed after such molding operation, as desired.

It has been found that the guide slots 80 and 81 and cooperating wing ends 60 and 61 can provide the sole guide means for the movement of the plunger member 56.

Therefore, it can be seen that the thermostat construction or control device 20 of this invention can be formed in a relatively simple manner by the method of this invention to operate in a manner now to be described.

As previously stated the thermostat construction 20 can be utilized for any desired purpose and presently the thermostat construction 20 is utilized as a water heater control wherein the same tends to maintain the temperature of the water in a water heater tank at the temperature selected by the control knob 75, the electrical switch means 31 cycling between its "off" and "on" condition to operate an electrical heater means for the tank whereby the temperature of the water therein will be maintained substantially at the temperature selected by the temperature setting means 72. However, should, for some reason, a run-away temperature condition occur wherein the temperature of the water in the water heater exceeds a safe temperature level thereof, the electrical switch means 32 will be operated to completely disconnect the electrical current to the switch means 31 so that the switch means 31 cannot control the electrical heater for the water heater tank until the switch means 32 is reset to an operating condition thereof.

Thus, by the operator setting the control knob 75 of the temperature setting means 22 in the desired temperature setting condition thereof, the force of the compression spring 77 has been so selected so that the same is urging the plunger member 56 downwardly in FIG. 2 with a certain force so that the projection 62 thereof is acting on the central part 63 of ths snap disc 27 to tend to prevent the same from snapping over center upon an increase in sensed temperature thereof below the selected temperature. At this time, the electrical contact 53 is being maintained into electrical contact with the fixed contact 54 to cause the electrical heater for the water heater tank to be operated to heat up the water therein to the temperature selected by the temperature setting means 72. When the temperature of the water in the water heater reaches the selected temperature of the temperature setting means 72, the snap disc 27 is sensing such temperature and will snap over center from the position illustrated in FIG. 3 to the position illustrated in FIG. 4 in opposition to force of the compression spring 77 whereby the plunger member 56 moves therewith and causes the switch blade 49 to move the movable contact 53 out of contact with the fixed contact 54 and against the stop 76 to thereby disrupt electrical current flow to the electrical heater so that the electrical heater will not continue to heat water in the water tank. Conversely, as the temperature of the water tank falls below the selected temperature, the snap disc 27 will snap back over center from the operating condition of FIG. 4 to the operating condition of FIG. 3 under the force of the compression spring 77 acting downardly thereon so that the switch blade 49 will now be permitted to move the movable contact 53 back into contact with the fixed contact 54 to again cause operation of the heater means of the water heater tank.

Therefore, it can be seen that as the temperature of the water in the water tank changes, the switch means 31 is cycled between its "off" and "on" condition to tend to maintain the temperature of the water in the water heater tank at the temperature selected by the temperature setting means 72.

As previously stated, should a run-away temperature condition exist in the water heater tank, the snap disc 28 of the electrical switch means 32 will sense such high temperature condition and snap over center to move the plunger 43 in a manner to move the switch members 33 and 34 out of bridging contact with the pairs of fixed contacts 35, 36 and 37, 38 to thereby break all electrical connection from the electrical source to the switch means 31 whereby the heater means for the water heater tank cannot be activated until the snap disc 28 is reset to its non operating condition of FIG. 2 by the reset member 44 as previously described.

Therefore, it can be seen that the thermostat construction or control device 20 of this invention has an improved plunger means 56 for operating the electrical switch means 31 in the manner previously described.

Another thermostat construction or control device of this invention is generally indicated by the reference numeral 20A in FIGS. 7–10 and parts thereof similar to the parts of the thermostat construction or control device 20 previously described are indicated by like reference numerals following by the reference letter "A".

Figure 10:
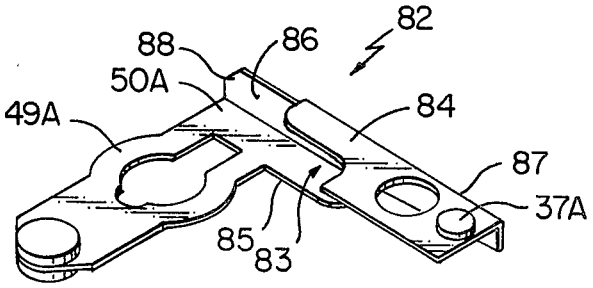
FIG. 10 is a perspective view of the improved lead means of the thermostat construction of FIG. 7.

The thermostat construction or control device 20A of this invention is substantially identical to the control device 20 previously described except that instead of utilizing the rigid lead member 45, the thermostat construction 20A has a one-piece lead means that is generally indicated by the reference numeral 82 and is formed of switch blade material that is shaped and folded in the manner illustrated in FIG. 10 to define a generally U-shaped section 83 that has a top member 84 and a bottom member 85 integrally interconnected together by a side member 86.

The top member 84 of the one-piece lead means 82 is fastened to the housing means 21A by the fastening means 46A previously described so that the U-shaped section 83 is mounted to the housing means 21A intermediate the opposed ends 87 and 88 which are disposed in cantilever fashion respectively in the switch chambers 23A and 22A and respectively form part of the electrical switch means 32A and 31A thereof.

In particular, the end 87 of the U-shaped section 83 carries the fixed contact 37A that cooperates with the other fixed contact 38A and the bridging switch member 34A in the manner previously described. The other end 88 of the U-shaped section 83 of the one-piece lead means 82 integrally carries a switch blade 49A that is shaped in the same manner as the switch blade 49 previously described except that the end 50A thereof is integral with the lower section 85 of the U-shaped section 83 while performing the same function as the switch blade 49 for the switch means 31A of the control device 20A.

Therefore, it can be seen that the one-piece lead means 82 permits the switch blade 49A and fixed contact 37A to be disposed in offset planes relative to each other by the unique U-shaped section 83 thereof so that the blade 49A and fixed contact 37A can operate in the same manner as the fixed contact 37 and switch blade 49 previously described, the rigid lead means 45 having an offset bend 89 therein to permit the fixed contact 37 and blade 49 to be disposed in offset planes relative to each other.

Therefore, it can be seen that the control device 20A operates in exactly the same manner as the control device 20 previously described so that the operation of the control device 20A need not be set forth.

Accordingly, it can be seen that this invention not only provides an improved thermostat construction or control device, but also this invention provides an improved method of making such a thermostat construction or control device.

While the forms and methods of this invention now preferred have been illustrated and described as required by the Patent Statute, it is to be understood that other forms and method steps can be utilized and still fall within the scope of the appended claims.

What is claimed is:

1. In a control device having a housing carrying a pair of thermostatically operated electrical switch means therein in spaced apart side-by-side relation and being electrically interconnected together in series by a one-piece lead means carried internally in said housing and having opposed ends and an intermediate portion while being secured to said housing intermediate said ends thereof whereby said ends are disposed in cantilever fashion with said ends respectively forming part of said switch means, the improvement wherein said intermediate portion of said lead means has a substantially U-shaped cross-sectional configuration defined by a cross member and a pair of substantially parallel spaced apart legs extending outwardly from said cross member, one of said legs having a movable switch blade integral therewith at one of said opposed ends of said lead means and extending outwardly therefrom for its respective switch means, the other of said legs carrying a fixed contact means for the other switch means at the other of said opposed ends of said lead means whereby said switch blade and said fixed contact means are disposed in offset planes by said legs of said one-piece lead means.

2. A control device as set forth in claim 1 wherein said switch blade and said lead means are one-piece and homogeneous and of the same thickness.

3. A control device as set forth in claim 1 wherein said switch blade has one end integral with said one leg of said lead means and another end disposed remote therefrom, said other end of said switch blade carrying a contact that comprises a movable contact of its said respective switch means.

4. A control device as set forth in claim 3 wherein said switch blade has an opening means passing therethrough intermediate said ends thereof.

5. A control device as set forth in claim 3 wherein said other leg is secured to said housing to secure said lead means thereto.

6. In a method of making a control device having a housing carrying a pair of thermostatically operated electrical switch means therein in spaced apart side-by-side relation and being electrically interconnected together in series by a one-piece lead means carried internally in said housing and having opposed ends and an intermediate portion while being secured to said housing intermediate said ends thereof whereby said ends are disposed in cantilever fashion with said ends respectively forming part of said switch means, the improvement comprising the steps of forming said intermediate portion of said lead means to have a substantially U-shaped cross-sectional configuration defined by a cross member and a pair of substantially parallel spaced apart legs extending outwardly from said cross member, forming one of said legs to have a movable switch blade integral therewith at one of said opposed ends of said lead means and extending outwardly therefrom for its respective switch means, and forming the other of said legs to carry a fixed contact means for the other switch means at the other of said opposed ends of said lead means whereby said switch blade and said fixed contact means are disposed in offset planes by said legs of said one-piece lead means.

7. A method of making a control device as set forth in claim 6 and including the step of forming said switch blade and said lead means to be one-piece and homogeneous and of the same thickness.

8. A method of making a control device as set forth in claim 6 and including the step of forming said switch blade to have one end integral with said one leg of said lead means and another end disposed remote therefrom, and forming said other end of said switch blade to carry a contact that comprises a movable contact of its said respective switch means.

9. A method of making a control device as set forth in claim 8 and including the step of forming said switch blade to have an opening means passing therethrough intermediate said ends thereof.

10. A method of making a control device as set forth in claim 8 and including the step of securing said one leg to said housing to thereby secure said lead means to said housing.

* * * * *